United States Patent [19]

Jahn

[11] 4,192,620

[45] Mar. 11, 1980

[54] LOOSE LEAF BINDER

[76] Inventor: Gerhard Jahn, Apt. 1907, 655 Broadview Ave, Toronto, Ontario, Canada

[21] Appl. No.: 4,811

[22] Filed: Jan. 19, 1979

Related U.S. Application Data

[63] Continuation of Ser. No. 636,817, Dec. 1, 1975, abandoned.

[51] Int. Cl.[2] ..... B42F 3/04

[52] U.S. Cl. ..... 402/15; 402/22; 402/80 P

[58] Field of Search ..... 402/8, 9, 13–15, 402/19–22, 75, 80 R; 282/29 C; 402/80 P

[56] References Cited

U.S. PATENT DOCUMENTS

| | | | |
|---|---|---|---|
| 2,042,366 | 5/1936 | Swank | 402/13 |
| 2,133,069 | 10/1938 | Williamson | 402/15 |
| 2,329,786 | 9/1943 | Ringler | 402/8 |
| 2,451,122 | 10/1948 | Sherwood | 402/15 |
| 2,559,556 | 7/1951 | Ambler | 402/75 |
| 2,575,583 | 11/1951 | Clarke et al. | 402/75 |
| 2,911,977 | 11/1959 | French | 402/15 |
| 3,197,830 | 8/1965 | Hoadley | 24/16 PB |
| 3,246,653 | 4/1966 | Sexton | 402/15 |
| 3,516,755 | 6/1970 | Smith | 402/9 |
| 3,834,824 | 9/1974 | Jahn | 402/13 |
| 3,850,488 | 11/1974 | Elias et al. | 402/13 |

FOREIGN PATENT DOCUMENTS

| | | | |
|---|---|---|---|
| 272010 | 2/1930 | Italy | 282/29 |

*Primary Examiner*—John McQuade

[57] ABSTRACT

An improved binder, of one step construction manufactured from a single sheet of material comprising front and back covers, a backing disposed therebetween joining the covers and forming a continuation of the plane of the adjacent covers a plurality of fastening means, each fastening means formed integrally from one portion of one of said covers and forming a continuation of the plane of said cover at the juncture of the fastening means and the cover thereby presenting a cut-out portion in the cover corresponding to the shape of the fastening means when a part of the fastening means is lifted from the plane of the binder cover, each of said fastening means comprising a strap and tab, the strap forming a continuation of the plane of the cover at one end, the tab being disposed at the other end of the strap and forming a continuation of the plane thereof and of a width at the juncture with the strap to define therewith at least one locking shoulder, a plurality of slots disposed in said binder, one slot for each fastening means, through which slot each fastening means is inserted for positioning exterior of the binder cover, for insertion through the cut-out portion in the cover to be positioned within the interior of the binder and be locked and secured therein by at least one locking shoulder of said tab engaging cover portions on either side of the cut-away portion.

4 Claims, 4 Drawing Figures

LOOSE LEAF BINDER

This is a continuation of application Ser. No. 636,817 filed Dec. 1, 1975, now abandoned.

FIELD OF INVENTION

This invention relates to binders, and more particularly, to a loose leaf binder manufactured in a one step operation from a single sheet of material.

BACKGROUND OF THE INVENTION

Most binders today are manufactured by joining together various individual components manufactured separately and later assembled to form the finished product. More particularly, loose leaf binders have been manufactured by heat sealing front and back sheets of plastic or polymeric material to sandwich a cardboard core to form front and back covers and a backing intermediate the two, and then securing metallic rings to the backing of the binder which method of manufacture was both time consuming and costly.

In my U.S. Pat. No. 3,834,824, I disclose a unique retaining means which can be substituted for the metallic rings. However, this retaining means must still be secured to the completed backing-cover combination of the binder by a separate operation, exclusive of its manufacture, with the result that material and time are wasted, very important considerations today when the cost of polymeric or plastics material, and labour have drastically escalated. Therefore, binders have become less attractive as a display for use by salesmen of large companies (e.g. insurance companies) for presentation of their products and services.

It is therefore, an object of this invention to provide a binder having a method of manufacture where material wastage and labour costs are reduced.

It is still a further object of the invention to provide a binder utilizing less material than the prior art binders.

It is still a further object of this invention to provide a highly reliable binder, maunfactured from a single sheet of material in a one step operation.

Further and other objects and advantages of the invention will be seen by those skilled in the art from the following summary of the invention and detailed description of two preferred embodiments thereof.

SUMMARY OF THE INVENTION

According to one important aspect of the invention, a complete binder is manufactured in a single operation from a single sheet of material having fastening means stamped in one cover.

According to another aspect of the invention, the completed binder includes fastening means, each fastening means comprising a strap and tab at one end of the strap, formed integrally from, and adjacent to the center of, the single sheet of material, the strap remaining attached at one end to the material and forms a continuation of the plane of the material at the juncture of the strap and material, the tab being disposed at the other end of the strap, and forming a continuation of the plane of the strap and of a width at the juncture with the strap, to define therewith at least one locking shoulder.

According to another aspect of the invention, an aperture is provided, preferably adjacent the centre of the material, one for each fastening means, through which the tab and a portion of the strap are passed and the tab is then inserted through the cut-away portion of the cover, which contained the material comprising the strap and tab prior to the stamping thereof, and locked within the binder.

According to another aspect of the invention, the binder is manufactured by positioning a sheet of material or a portion thereof, when a roll of material is used, and substantially simultaneously, preferably either by heat sealing or die cutting, shaping and sizing said sheet and additionally severing a portion of material from the roll, if a roll of material is used, and forming the above described fastening means and aperture arrangement for the binder.

BRIEF DESCRIPTION OF THE DRAWINGS

Although this invention finds wide application in the manufacture of binders and related products, the invention will be illustrated with respect to a preferred embodiment thereof, illustrated in the attached drawings in which.

DETAILED DESCRIPTION OF A PREFERRED EMBODIMENT OF THE INVENTION

Figure 1:
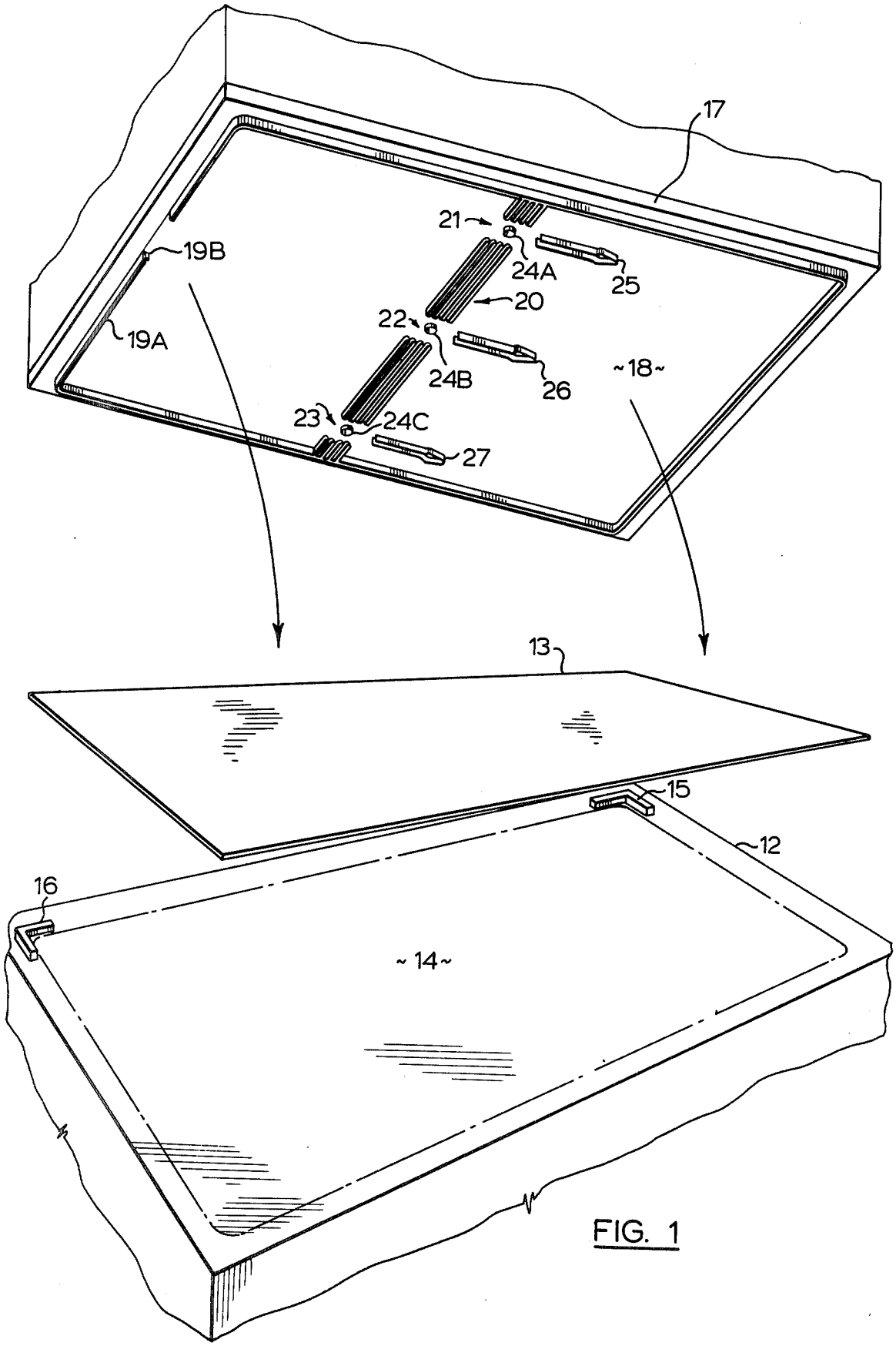
FIG. 1 is a perspective exploded view of a sheet of material and requisite components of an apparatus used to form a binder according to a preferred embodiment of the invention.

Referring to FIG. 1, conventional heat sealing apparatus known in the art is provided for carrying out the process according to the preferred embodiment of the invention and comprises a base 12, on which a sheet of material 13 is disposed. Base 12 has, on the upper surface thereof, barrier board 14, on which the material will seat and has at the corners, L-bars 15 and 16 (the other two not being shown) for precisely positioning the sheet of material in relation to the apparatus. Upper plate 17, is reciprocally moveable vertically from a position spaced from the base 12 to a position proximate the base 12 to contact the sheet of material 13 for a predetermined length of time, and then vertically elevated to its original position. On the under-surface 18 of plate 17 are disposed cutting and sealing rules known in the art, of predetermined shape and size and so positioned for the purposes hereinafter described. Adjacent the periphery of under-surface 18, are endless cutting and sealing rules 19A and 19B, sealing rule 19B being interior of cutting rule 19A and recessed relative thereto, for cutting sheet of material 13 to a specific size and shape, in this case rectangular, and finishing the edges thereof, respectively. Disposed at the centre of the area enclosed by endless sealing rule 19B of under-surface 18 are transverse sealing rules 20 (in this case 4) being interrupted at portions 21, 22 and 23. These rules when contacting the material do not cut through the material but rather bulge the material by concentrating the material outwardly at the points of contact to form ribs for folding.

Annular cutting rules 24A, 24B and 24C are disposed in spaces 21, 22 and 23, respectively to form annular apertures in the material when the apparatus is in operative contact with the material. The cutting rules 25, 26 and 27 are so shaped to produce the strap and tab combination, i.e. the fastening means of the description hereinafter provided.

Figure 2:
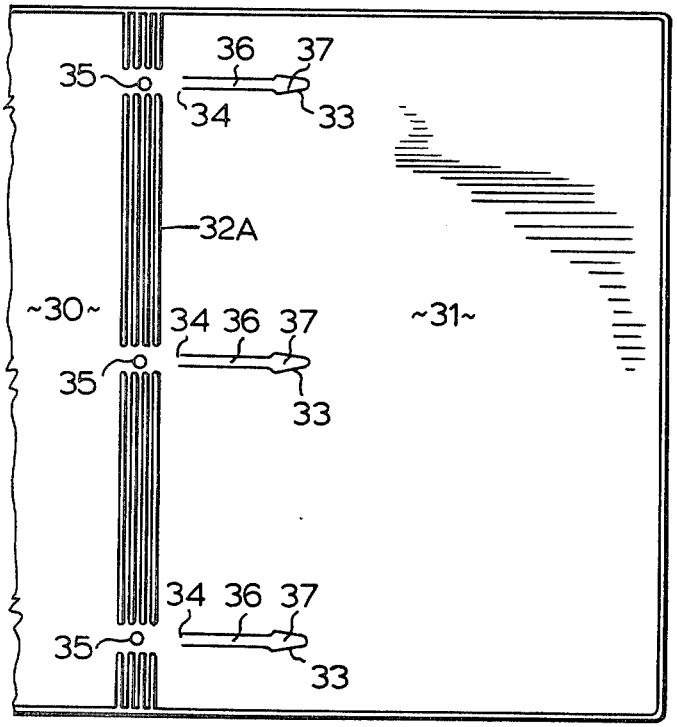
FIG. 2 is a plan view of a portion of the interior of the binder formed by the apparatus of FIG. 1.

When plate 17 is lowered to contact sheet 13 and the electrical current directed through the various rules on the undersurface 18 of plate 17, the material 13 is appropriately cut by the cutting rules or sealed by the sealing rules, with the resultant formation of the binder, only a portion of which is shown in FIG. 2.

Figure 3:
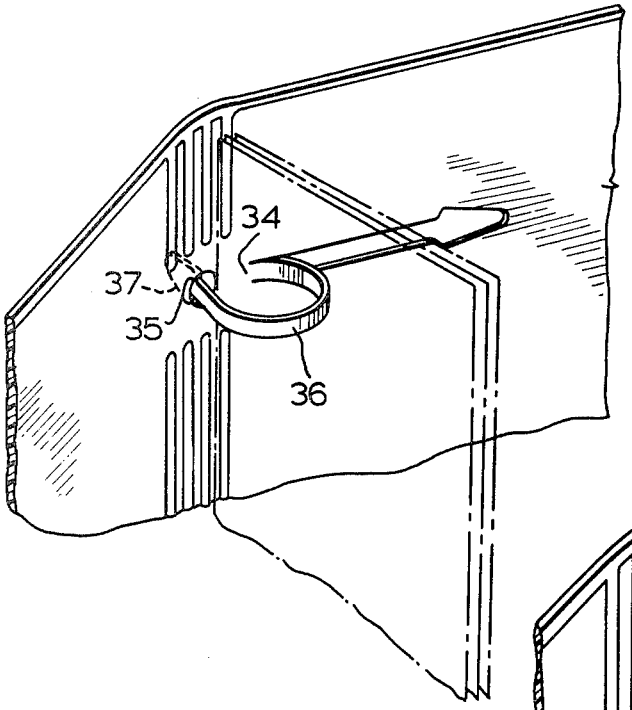
FIGS. 3 and 4 are close-up views of a portion of the binder of FIG. 2, illustrating the securing of the fastening means, according to the above preferred embodiment of the invention.
Figure 4:
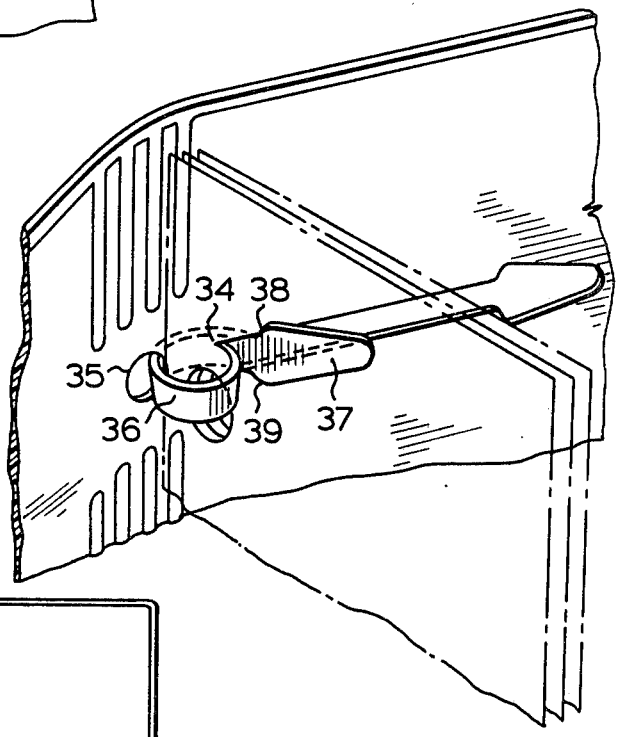

Referring to FIG. 2, this binder is of a one step construction manufactured from the single sheet of material 13 and comprises both front cover 30 and back cover 31, a backing disposed intermediate the two having transverse ribbing 32*a* to permit closure of the binder, a plurality of fastening means 33, each fastening means comprising a strap 36 and tab 37 formed integrally from one portion of the back cover 31, which fastening means forms a continuation of the plane of the cover 31 at the juncture 34 of the fastening means 33 and the cover 31. The tab 37 at the end of the fastening means forms a continuation of the plane of the strap and is of a width at the juncture with the strap to define therewith a pair of locking shoulders 38 and 39. The tab 37 is tapered from a wider portion adjacent the locking shoulders 38 and 39 to a narrower portion at its tip. A plurality of annular apertures 35, have been provided, one aperture for each fastening means, for insertion of tab 33 therethrough, for positioning of the fastening means exterior the binder, as shown in FIG. 3. The tab 33 is then pushed through the cut-out portion in the cover 31 adjacent the portion 37 from which the strap 33 was removed and the shoulders being of greater transverse width than the width of portion 36, the shoulders and thereby the tab are locked within the binder until sufficient force is exerted to remove the tab as shown in FIG. 4. In such position, the portion of the strap remaining within the binder presents a ring on which loose leaf paper has been previously secured, which permits the paper to freely slide thereon.

Therefore, when a binder cover is opened, the paper will lie flat therein. As a result, a presentation folder has been provided by this invention, which is of reliable construction, easily manufactured, yet is relatively inexpensive to manufacture, thereby satisfying the needs of insurance companies in their requirement of an inexpensive, yet reliable binder for presentation purposes.

Since, for example, the slots could be made, i.e. elliptical, circular, or parabolic in shape, in the construction of the binder, without departing from the scope of the invention, it is intended that all matter contained in the specification and the appended drawings shall be interpreted as illustrative of the invention and shall not be interpreted in a limiting sense.

The embodiments of the invention in which an exclusive property or privilege is claimed are as follows:

1. A binder of one step construction manufactured from a single sheet of material comprising front and back covers, a spine disposed therebetween joining said covers at hinge lines about which the covers pivot relative to the spine, and forming a continuation of the plane of the adjacent covers, a plurality of fastening means, each fastening means formed integrally from a portion of one of said covers thereby presenting a cut-out portion in the cover corresponding to the shape of the fastening means when a part of the fastening means is lifted from the plane of the binder cover, each of said fastening means comprising a thin, narrow, bendable strap and a wider tab, said strap being connected to the cover at one end, said tab being disposed at the other end of said strap, and being of a width at the juncture with the strap to define therewith at least one locking shoulder, a plurality of apertures disposed in said spine, one aperture for each fastening means, each said fastening means being inserted through the corresponding aperture for positioning exterior of the binder cover and said tab inserted through the corresponding cut-out portion in the cover to be positioned within the interior of the binder and be locked and secured therein by at least one locking shoulder of said tab engaging cover portions on either side of the cut-out portion.

2. The binder of claim 1, wherein said apertures are each annular.

3. The binder of claim 1, wherein said at least one locking shoulder comprises a pair of locking shoulders.

4. The binder of claim 1, wherein said material comprising said binder is a plastic material.

* * * * *